US005404406A

United States Patent [19]

Fuchigami et al.

[11] Patent Number: 5,404,406

[45] Date of Patent: Apr. 4, 1995

[54] METHOD FOR CONTROLLING LOCALIZATION OF SOUND IMAGE

[75] Inventors: Norihiko Fuchigami, Yokohama; Masahiro Nakayama, Sagamihara; Yoshiaki Tanaka, Fujisawa; Takuma Suzuki; Mitsuo Matsumoto, both of Yokosuka, all of Japan

[73] Assignee: Victor Company of Japan, Ltd., Yokohama, Japan

[21] Appl. No.: 159,254

[22] Filed: Nov. 30, 1993

[30] Foreign Application Priority Data

Nov. 30, 1992 [JP] Japan ..... 4-343459
Nov. 30, 1992 [JP] Japan ..... 4-343460

[51] Int. Cl.[6] ..... H04R 5/00
[52] U.S. Cl. ..... 381/17; 381/26
[58] Field of Search ..... 381/17, 26, 1

[56] References Cited

U.S. PATENT DOCUMENTS

| | | | |
|---|---|---|---|
| 3,236,949 | 2/1966 | Atal et al. . | |
| 4,159,397 | 6/1979 | Iwahara et al. . | |
| 4,188,504 | 2/1980 | Kasuga et al. . | |
| 4,739,513 | 4/1988 | Kunugi et al. | 381/26 |
| 5,105,462 | 4/1992 | Lowe et al. . | |
| 5,173,944 | 12/1992 | Begault | 381/17 |

FOREIGN PATENT DOCUMENTS

| | | | |
|---|---|---|---|
| 58-3638 | 1/1983 | Japan . | |
| 58-50812 | 3/1983 | Japan . | |
| 2412299 | 9/1989 | Japan | 381/26 |
| 2237400 | 9/1990 | Japan | 381/17 |
| 3270400 | 12/1991 | Japan . | |
| 4014999 | 1/1992 | Japan | 381/17 |

OTHER PUBLICATIONS

"Construction of Orthostereophonic System for the Purposes of Quasi-Insitu Recording and Reproduction" by H. Hamada; Journal Acoustical Society of Japan (J); vol. 39, No. 5, 1983; pp., 337-348 (w/ English abstract).

"A Method for Binaural Stereophonic Reproduction" by K. Yamakoshi; Journal of Acoustical Society of Japan (J); vol. 39, No. 5, p.349 (w/ English translation), 1983.

*Primary Examiner*—Curtis Kuntz
*Assistant Examiner*—Ping W. Lee
*Attorney, Agent, or Firm*—Pollock, Vande Sande & Priddy

[57] ABSTRACT

A method for reproducing sounds from signals, which are supplied from a same sound source through a pair of localization filters by using a pair of transducers disposed apart from each other and for controlling the localization of a sound image in such a way to make a listener feel that he hears sounds from a virtual sound source which is localized at a desired sound image location being different from the positions of the transducers. When performing this method, a signal for measurement reproduced at each sound image location is measured at the listener's position as data to be used for estimating head-related transfer characteristics. Then, the head-related transfer characteristics corresponding to each sound image location are estimated from the measured data. Subsequently, transfer characteristics of the pair of the localization filters, which characteristics of which are necessary for localizing a sound image at each sound image location, are calculated on the basis of the estimated head-related transfer characteristics. Next, a scaling processing is performed to obtain the coefficients of the pair of the localization filters as an impulse response. Then, the coefficients obtained by the scaling processing are set in a pair of convolvers. Finally, sound signals are supplied from the sound source to the pair of the convolvers. Further, outputs of the pair of the convolvers are reproduced from the pair of the transducers.

7 Claims, 10 Drawing Sheets

FREQUENCY-AMPLITUDE CHARACTERISTICS OF REFERENCE TRANSFER CHARACTERISTICS

FREQUENCY-AMPLITUDE CHARACTERISTICS OF REFERENCE TRANSFER CHARACTERISTICS

FREQUENCY-AMPLITUDE CHARACTERISTICS OF INTERMEDIATE TRANSFER CHARACTERISTICS (OBSERVED VALUES)

FREQUENCY-AMPLITUDE CHARACTERISTICS OF INTERMEDIATE TRANSFER CHARACTERISTICS (ARITHMETIC MEAN)

FREQUENCY-AMPLITUDE CHARACTERISTICS OF INTERMEDIATE TRANSFER CHARACTERISTICS (GEOMETRIC MEAN)

METHOD FOR CONTROLLING LOCALIZATION OF SOUND IMAGE

BACKGROUND OF THE INVENTION

1. Field of The Invention

The present invention generally relates to a method for controlling the localization (hereunder sometimes referred to as sound image localization) of a sound source image (incidentally, a sound source image is a listener's acoustic and subjective image of a sound source and will hereunder be referred to simply as a sound image) in such a manner to be able to make a listener feel that he hears sounds emitted from a virtual sound source (namely, the sound image) which is localized or located at a desired position being different from the position of a transducer (for example, a speaker), and more particularly to a method for controlling the localization of a sound image, which can be employed by what is called an amusement game machine (namely, a computer game (or video game) device) and a computer terminal and can reduce the size of a circuit without hurting the above-mentioned listener's feeling about the sound image localization. Further, the present invention relates to a method for reproducing sounds from signals, which are supplied from a same sound source through a plurality of signal conversion circuits, by using transducers disposed apart from each other and for controlling the localization of a sound image in such a way to be able to make a listener feel that he hears sounds from a virtual sound source (namely, the sound image) which is localized at a desired position being different from the positions of the transducers (for instance, speakers). Especially, the present invention relates to the improvement of calculation of data to be used for controlling the sound image localization (namely, the improvement of calculation of transfer characteristics of signal conversion circuits).

2. Description of The Related Art

A conventional sound image localization method employs what is called a binaural technique which utilizes the signal level difference and phase difference (namely, time difference) of a same sound signal issued from a sound source between the ears of a listener and makes the listener feel as if the sound source were localized at a specific position (or in a specific direction) which is different from the actual position of the sound source (or the actual direction in which the sound source is placed).

A conventional sound image localization method utilizing an analog circuit, which was developed by the Applicant of the instant application, is disclosed in, for example, the Japanese Laying-open Patent Application Publication Official Gazette (Tokkyo Kokai Koho) NO. S53-140001 (namely, the Japanese Patent Publication Official Gazette (Tokkyo Kokoku Koho) NO. S58-3638)). This conventional method is adapted to enhance and attenuate the levels of signal components of a specific frequency band (namely, controls the amplitude of the signal) by using an analog filter such that a listener can feel the presence of a sound source in front or in the rear. Further, this conventional method employs analog delay elements to cause the difference in time or phase between sound waves respectively coming from the left and right speakers (namely, controls the phase of the signal) such that a listener can feel the presence of the sound source at the left or right side of him.

However, this conventional sound image localization method employing an analog circuit as described above has drawbacks in that it is very costly and difficult from a technical point of view to precisely realize head related characteristics (namely, a head related transfer function (hereunder abbreviated as HRTF)) in connection with the phase and amplitude corresponding to each frequency of the signal and that generally, it is very difficult to localize the sound source at a given position in a large space which subtends a visual angle (namely, the difference between maximum and minimum azimuth angles measured from the listener's position) of more than 180 degrees at the listener's eye.

Further, there has been another conventional sound image localization method realized with the recent progress of digital processing techniques, which is disclosed in, for instance, the Japanese Laying-open Patent Application Publication Official Gazette NO. H2-298200 (incidentally, the title of the invention is "IMAGE SOUND FORMING METHOD AND SYSTEM").

In case of this sound image localization method using a digital circuit, a Fast Fourier Transform (FFT) is first performed on a signal issued from a sound source to effect what is called a frequency-base (or frequency-dependent-basis) processing (i.e., a processing to be performed in a frequency domain (hereunder sometimes referred to simply as a frequency-domain processing)), namely, to give signal level difference and a phase difference, which depend on the frequencies of signals, to left and right channel signals. Thus, the digital control of sound image localization is achieved. In case of this conventional method, the signal level difference and the phase difference at a position at which each sound image is located, which differences depend on the frequencies of signals, are collected as experimental data by utilizing actual listeners.

Such a sound image localization method using a digital circuit, however, has drawbacks in that the size of the circuit becomes extremely large when the sound image localization is achieved precisely and accurately. Therefore, such a sound image localization method is employed only in a recording system for special business use. In such a system, a sound image localization processing (for example, the shifting of an image position of a sound of an air plane) is effected at a recording stage and then sound signals (for instance, signals representing music) obtained as the result of the processing are recorded. Thereafter, the effects of shifting of a sound image is obtained by reproducing the processed signal by use of an ordinary stereophonic reproducing apparatus.

Meanwhile, there have recently appeared what is called an amusement game machine and a computer terminal, which utilize virtual reality. Further, such a machine or terminal has come to require real sound image localization suited to a scene displayed on the screen of a display thereof.

For example, in case of a computer game machine, it has become necessary to effect a shifting of the sound image of a sound of an air plane, which is suited to the movement of the air plane displayed on the screen. In this case, if the course of the air plane is predetermined, sounds (or music) obtained as the result of shifting the sound image of the sound of the air plane in such a manner to be suited to the movement of the air plane are recorded preliminarily. Thereafter, the game machine reproduces the recorded sounds (or music) simply and easily.

However, in case of such a game machine computer terminal), the course (or position) of an air plane changes according to manipulations performed by an operator thereof. Thus, it has become necessary to perform a real-time shifting of a sound image according to manipulations effected by the operator in such a way to be suited to the manipulations and thereafter reproduce sounds recorded as the result of the shifting of the sound image. Such a processing is largely different in this respect from the above described sound image localization for recording.

Therefore, each game machine should be provided with a sound image localization device. However, in case of the above described conventional method, it is necessary to perform an FFT on signals emitted from a sound source and the frequency-base processing (namely, the frequency-domain processing) and to effect an inverse FFT for reproducing the signals. As a result, the size of a circuit used by this conventional method becomes very large. Consequently, this conventional method cannot be a practical measure for solving the problem. Further, in case of the above described conventional method, the sound image localization is based on frequency-base data (or data in a frequency domain (namely, data representing the signal level difference and the phase difference which depend on the frequency of a signal)). Thus, the above described conventional method has a drawback in that when an approximation processing is performed to reduce the size of the circuit, transfer characteristics (or an HRTF) cannot be accurately approximated and thus it is difficult to localize a sound image in a large space as subtending a visual angle of more than 180 degrees at a listener's eye. The present invention is accomplished to eliminate such a drawback of the conventional method.

It is, accordingly, an object of the present invention to provide a method for controlling sound image localization, which can reduce the size of a circuit to be used and the cost and can localize a sound image in a large space as subtending a visual angle of more than 180 degrees at a listener's eye. As will be described later, an aspect of such a method resides in that a sound image is localized by processing signals issued from a sound source on a time base or axis (namely, in a time domain) by use of a pair of convolvers. Thereby, the size of the circuit can be very small. Further, this method can be employed in a game machine for private or business use. Moreover, another aspect of such a method resides in that data for a sound image localization processing by the convolvers is finally supplied as data for a time-base impulse response (namely, an impulse response obtained in a time domain (hereunder sometimes referred to simply as a time-domain impulse response)). Thereby, transfer characteristics can be accurately approximated without deteriorating the sound image localization and the size of a circuit (thus, the number of coefficients of the convolvers) can be further smaller.

In case of this new method for controlling sound image localization, the time response (namely, transfer characteristics) of the convolver is obtained from results of the measurement of HRTF. However, if the characteristics are considered as the frequency response, the characteristics have sharp peaks and dips.

In case where such transfer characteristics (namely, the time response) are used as those of the convolver without any modification, sound quality obtained at the time of implementing sound image localization becomes unnatural due to the presence of the peaks and dips in the frequency characteristics. This means that there is some limit to the actual measurement of HRTF.

Moreover, the time response (namely, the impulse response) per se also has sharp peaks and dips. This results in that the convergency of the convolver is not sufficient and thus the size of the circuit (namely, the number of coefficients of the convolver) does not become so small. The present invention further seeks to solve such problems.

It is, therefore, another object of the present invention to provide an improved method for controlling sound image localization, which can improve the calculation of transfer characteristics of a signal conversion circuit and also improve the sound quality and reduce the size of the circuit.

SUMMARY OF THE INVENTION

To achieve the foregoing object, in accordance with an aspect of the present invention, there is provided a method for reproducing sounds from signals, which are supplied from a same sound source (corresponding to s(t) of FIG. 2) through a pair of localization filters (corresponding to a convolution operation circuit composed of what is called localization filters, the coefficients of which are cfLx(t) and cfRx(t), respectively, of FIG. 2), by using transducers (corresponding to speakers sp1 and sp2 of FIG.2) disposed apart from each other and for controlling the localization of a sound image in such a way to be able to make a listener feel that he hears sounds from a virtual sound source (namely, the sound image) which is localized at a desired position (corresponding to x of FIG. 2) being different from the positions of the transducers. This method comprises the step of measuring a signal which is reproduced at each sound image location, at the listener's position as data to be used for estimating head-related transfer characteristics (corresponding to step 101 of FIG. 1). The head-related transfer characteristics corresponding to each sound image location are estimated from the measured data (corresponding to step 102 of FIG. 1). The transfer characteristics of the pair of the localization filters are calculated, for localizing a sound image at each sound image location, on the basis of the estimated head-related transfer characteristics (corresponding to step 104 of FIG. 1). A scaling processing is performed to obtain coefficients form the pair of the localization filters as an impulse response (corresponding to step 105 of FIG. 1). The coefficients obtained by the scaling processing are used in a pair of convolvers. Sound signals from the sound source are supplied to the pair of the convolvers and from the convolers to the pair of the transducers (corresponding to step 108 of FIG. 1).

Thereby, head-related transfer characteristics corresponding to each sound image location is accurately approximated and estimated. Thus coefficient data (corresponding to cfLx and cfRx) of the pair of the localization filters, which data is necessary for localizing a sound image at each sound image location, can be obtained by being accurately approximated as an impulse response. Then, convolution operations are performed on signals sent from the sound source (corresponding to s(t)) in a time domain (on a time base or axis) by the pair of the convolvers. Subsequently, outputs of the convolvers are reproduced from the pair of the transducers (corresponding to the speakers sp1 and sp2) disposed apart from each other. At that time, acoustic crosstalk perceived by the ears of the listener is cancelled from sounds reproduced by the pair of the transducers. As a result, the listener (for example, an operator of a computer game machine) M hears the sounds as if the sound source were located at a desired position (corresponding to x). Thus, only the time-base convolution operation circuits are needed as circuits for actually performing a sound image processing. Consequently, the size of the circuit becomes very small and the cost becomes very low. Moreover, the coefficient data used for the sound image processing performed by the convolvers is supplied as time-base IR data. Thus, the size of the circuit can be further reduced by decreasing the number of the coefficients of the convolvers. As a consequence, in comparison with the approximation of the frequency-base data in case of the conventional method, head related transfer characteristics can be approximated more precisely and efficiently. Thus, the size of the circuit can be further reduced without deteriorating the sound image localization. Consequently, the method of the present invention can be easily employed in a game machine and a computer terminal for private use.

Furthermore, in accordance with another aspect of the present invention, there is provided another method for reproducing sounds from signals, which are supplied from a same sound source (corresponding to s(t)) through a pair of convolvers (corresponding to the convolution operation circuit composed of localization filters, the coefficients of which are cfLx(t) and cfRx(t), respectively), by using transducers (corresponding to the speakers sp1 and sp2) disposed apart from each other. The localization of a sound image is controlled in such a manner as to be able to make a listener feel that he hears sounds from a virtual sound source (namely, the sound image) which is localized at a desired position (corresponding to x) being different from the positions of the transducers. Additionally, this method comprises the steps of measuring a signal which is reproduced at each sound image location, at the listener's position as data to be used for estimating head-related transfer characteristics (corresponding to step 201 of FIG. 9). The head-related transfer characteristics are estimated corresponding to each sound image location from the measured data (corresponding to step 202 of FIG. 9). The transfer characteristics of the pair of the localization filters are calculated which are necessary for localizing a sound image at each sound image location on the basis of the estimated head-related transfer characteristics (corresponding to step 204 of FIG. 9). The discrete frequency response is obtained by performing FFT on the head related transfer characteristics and then effecting a moving average (or running mean) processing using a band width optimized according to critical band width and next performing an inverse FFT on data obtained as the result of the moving average processing to obtain an improved transfer characteristics of the signal conversion circuits (corresponding to step 205 of FIG. 9).

Thus, as is apparent from FIGS. 10(A) to 10(D), unnecessary peaks and dips are eliminated, while the features of the frequency response, which are necessary for the sound image localization, are maintained. Further, the transfer characteristics of the signal conversion circuits (namely, the impulse response or coefficients of the convolvers) are determined on the basis of the resultant frequency response. As a result, natural sound quality can be obtained. Moreover, the convergence of the time response to be realized can be promoted and quickened as the result of the moving average processing. Furthermore, the cost can be decreased. Consequently, the method of the present invention can be easily employed in a game machine and a computer terminal for private use so as to control the sound image localization therein.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which:

FIG. 10(A) showing data representing the time response of the signal conversion circuits (namely, the convolvers) obtained from the measured HRTF; FIG. 10(B) showing data which represents the discrete frequency response obtained by performing FFT on the data shown in FIG. 10(A); FIG. 10(C) showing data which represents the discrete frequency response obtained by performing a moving average processing on the data shown in FIG. 10(B) according to the critical band width; and FIG. 10(D) showing data which represents the time response of the signal conversion circuits (namely, the convolvers) obtained by performing an inverse FFT on the data shown, in FIG. 10(C);

DETAILED DESCRIPTION OF THE PREFERRED EMBODIMENTS

Hereinafter, a preferred embodiment (namely, the first embodiment) of the present invention will be described in detail by referring to the accompanying drawings.

First, the fundamental principle of the method for controlling sound image localization (namely, the method of the first embodiment) according to the present invention will be explained hereinbelow. This technique is employed to localize a sound image at an arbitrary position in space by using a pair of transducers (hereinafter, it is assumed that for example, speakers are used as the transducers) disposed apart from each other.

Figure 3:
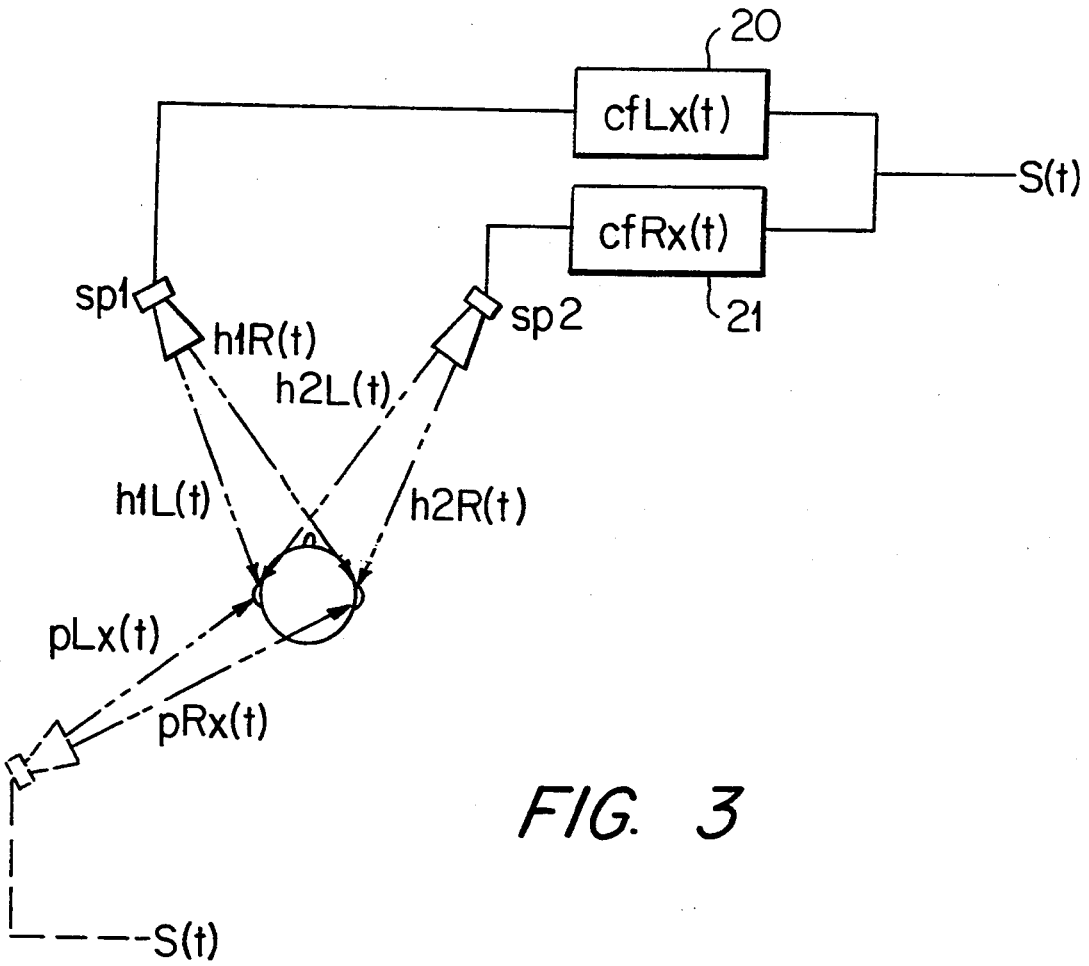
FIG. 3 is a schematic block diagram for illustrating the fundamental principle of the method for controlling sound image localization according to the present invention.

FIG. 3 is a schematic block diagram for illustrating the fundamental principle of the method of the first embodiment of the present invention. In this figure, reference characters sp1 and sp2 denote speakers disposed leftwardly and rightwardly in front of a listener, respectively. Here, let h1L(t), h1R(t), h2L(t) and h2R(t) designate the head-related transfer characteristics (namely, the impulse response) between the speaker sp1 and the left ear of the listener, those between the speaker sp1 and the right ear of the listener, those between the speaker sp2 and the left ear of the listener and those between the speaker sp2 and the right ear of the listener, respectively. Further, let pLx(t) and pRx(t) designate the head-related transfer characteristics between a speaker placed actually at a desired location (hereunder sometimes referred to as a target location) x and the left ear of the listener and those between the speaker placed actually at the target location x and the right ear of the listener, respectively. Here, note that the transfer characteristics h1L(t), h1R(t), h2L(t) and h2R(t) are obtained by performing an appropriate waveform shaping processing on data actually measured by using a speaker and microphones disposed at the positions of the ears of the dummy head (or a human head) in acoustic space.

Next, it is considered how signals obtained through the signal conversion devices (namely, the convolvers), the transfer characteristics of which are cfLx(t) and cfRx(t), from the sound source s(t) to be localized should be reproduced by the speakers sp1 and sp2, respectively. Here, let eL(t) and eR(t) denote signals obtained at the left ear and the right ear of the listener, respectively. Further, the signals eL and eR are given by the following equations in time-domain representation:

$$eL(t)=h1L(t)*cfLx(t)*s(t)+h2L(t)*cfRx(t)*s(t) \quad (1a1)$$

$$eR(t)=h1R(t)*cfLx(t)*s(t)+h2R(t)*cfRx(t)*s(t) \quad (1a2)$$

(Incidentally, character * denotes a convolution operation). Further, the corresponding equations in frequency-domain representation are as follows:

$$EL(\omega)=H1L(\omega t)\cdot CfLx(\omega)\cdot S(\omega)+H2L(\omega)\cdot CfRx(\omega)\cdot S(\omega) \quad (1b1)$$

$$ER(\omega)=H1R(\omega t)\cdot CfLx(\omega)\cdot S(\omega)+H2R(\omega)\cdot CfRx(\omega)\cdot S(\omega) \quad (1b2)$$

On the other hand, let dL and dR denote signals obtained at the left ear and the right ear of the listener, respectively, when the sound source s(t) is placed at the target location. Further, the signals dL(t) and dR(t) are given by the following equations in time-domain representation:

$$dL(t)=pLx(t)*s(t) \quad (2a1)$$

$$dR(t)=pRx(t)*s(t) \quad (2a2)$$

Furthermore, the corresponding equations in frequency-domain representation are as follows:

$$DL(\omega)=PLx(\omega)\cdot S(\omega) \quad (2b1)$$

$$DR(\omega)=PRx(\omega)\cdot S(\omega) \quad (2b2)$$

If the signals, which are obtained at the left ear and the right ear of the listener when reproduced by the speakers sp1 and sp2, match the signals, which are obtained at the left ear and the right ear of the listener, respectively, when the sound source s(t) is placed at the target location (namely, eL(t)=dL(t) and eR(t)=dR(t), thus, EL(ω)=DL(ω) and ER(ω)=DR(ω)), the listener perceives a sound image as if the speakers were disposed at the target location. If S(ω) is eliminated from these equations and the equations (1b1), (1b2), (2b1) and (2b2), the transfer characteristics are obtained as follows:

$$CfLx(\omega)=\{H2R(\omega)\cdot PLx(\omega)-H2L(\omega)\cdot PRx(\omega)\}\cdot G(\omega) \quad (3a1)$$

$$CfRx(\omega)=\{-H1R(\omega)\cdot PLx(\omega)+H1L(\omega)\cdot PRx(\omega)\}\cdot G(\omega) \quad (3a2)$$

where $G(\omega)=1/\{H1L(\omega)\cdot H2R(\omega)-H2L(\omega)\cdot H1R(\omega)\}$ Further, the transfer characteristics in time-domain representation cfLx(t) and cfRx(t) are found as follows by performing inverse Fourier transforms on both sides of each of the equations (3a1) and (3a2):

$$cfLx(t)=\{h2R(t)*pLx(t)-h2L(t)*pRx(t)\}*g(t) \quad (3b1)$$

$$cfRx(t)=\{-h1R(t)*pLx(t)+h1L(t)*pRx(t)\}*g(t) \quad (3b2)$$

where g(t) is obtained by performing an inverse Fourier transform on G(ω).

Furthermore, the sound image can be located at the target position x by preparing a pair of localization filters 20, 21 for implementing the transfer characteristics CfLx(ω) and CfRx(ω) represented by the equations (3a1) and (3a2) or the time responses cfLx(t) and cfRx(t) represented by the equations (3b1) and (3b2) and then processing signals, which are issued from the sound source to be localized, by use of the convolvers (namely, the convolution operation circuits 20, 21). Practically, various signal conversion devices can be implemented. For instance, the signal conversion devices may be implemented by using asymmetrical finite impulse response (FIR) digital filters 20, 21 (or convolvers). Incidentally, in case of this embodiment, as will be described later, the transfer characteristics; realized by a pair of convolvers are made to be a time response (namely, an impulse response).

Namely, a sequence of coefficients (hereunder referred to simply as coefficients) are preliminarily prepared as data to be stored in a coefficient read-only memory (ROM) 30, for the purpose of obtaining the transfer characteristics cfLx(t) and cfRx(t) when the sound source is located at the sound image location x, by performing a localization filtering only once. Thereafter, the coefficients needed for the sound image localization are transferred from the ROM to the pair of the localization filters whereupon a convolution operation is performed on signals sent from the sound source. Then, the sound image can be located at the desired given position by reproducing sounds from the signals obtained as the result of the convolution operation by use of the speakers.

Figure 1:
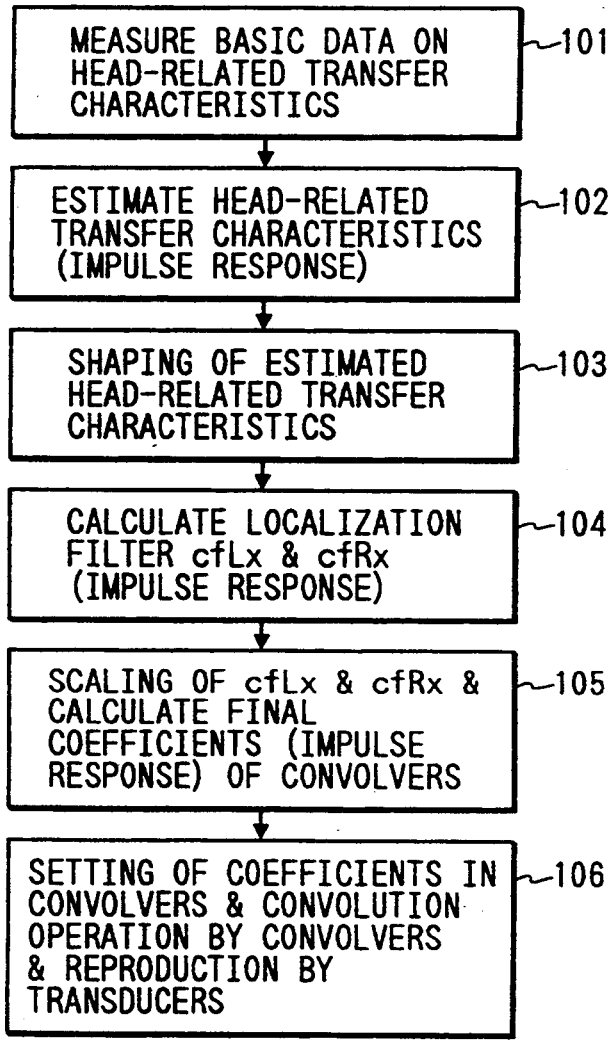
FIG. 1 is a flowchart for illustrating a method for controlling sound image localization according to the present invention (hereunder sometimes referred to as a first embodiment of the present invention)

This method for controlling the sound image localization, which is based on the principle explained heretofore, will be described in detail by referring to FIG. 1. Incidentally, FIG. 1 is a flowchart for illustrating steps of this method (namely, the first embodiment of the present invention).

① Measurement of Basic Data on Head Related Transfer Characteristics (HRTF) (step 101)

Figure 4:
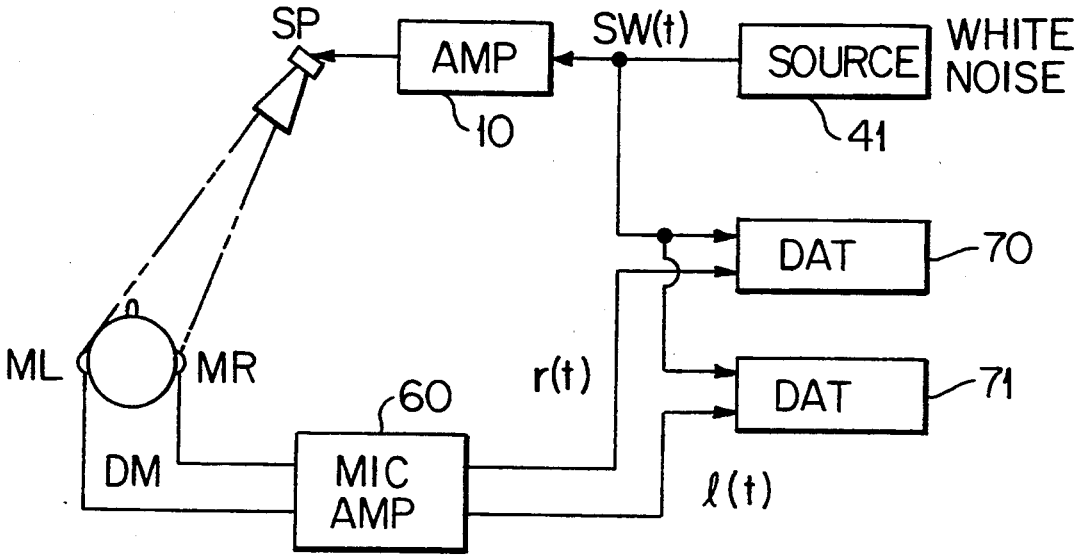
FIG. 4 is a schematic block diagram for illustrating the configuration of a system for measuring basic data on head-related transfer characteristics.

This will be explained by referring to FIGS. 4 and 5. FIG. 4 is a schematic block diagram for illustrating the configuration of a system for measuring basic data on the head-related transfer characteristics. As illustrated in this figure, a pair of microphones ML and MR are set at the positions of the ears of a dummy head (or a human head) DM. These microphones receive from the speakers sounds to be measured. Further, a source sound sw(t) (namely, reference data) and the sounds l(t) and r(t) to be measured (namely, data to be measured) L and R are amplified in microphone amplifier 60 and recorded by recorders DAT 70, 71 in synchronization with one another.

Incidentally, impulse sounds and noises such as a white noise 41 may be used as the source sound sw(t). Especially, it is said from statistical point of view that a white noise is preferable for improving the signal-to-noise ratio (S/N) because of the facts that the white noise is a continuous sound and that the energy distribution of the white noise is constant over what is called an audio frequency band.

Figure 5:
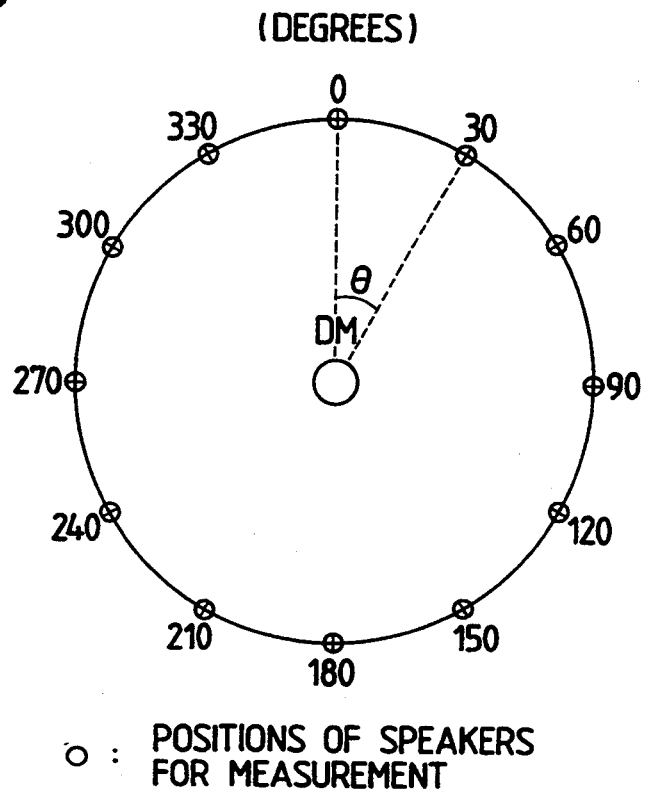
FIG. 5 is a diagram for illustrating the arrangement of points or position at which the head-related transfer characteristics are measured.

Additionally, the speakers SP are placed at positions (hereunder sometimes referred to as measurement positions) corresponding to a plurality of central angles $\theta$ (incidentally, the position of the dummy head (or human head) is the center and the central angle corresponding to the just front of the dummy head is set to be 0 degree), for example, at 12 positions set every 30 degrees as illustrated in FIG. 5. Furthermore, the sounds radiated from these speakers are recorded continuously for a predetermined duration. Thus, basic data on the head related transfer characteristics are collected and measured.

② Estimation of Head Related Transfer Characteristics (Impulse Response) (step 102)

In this step, the source sound sw(t) (namely, the reference data) and the sounds l(t) and r(t) to be measured (namely, the data to be measured) recorded in step 101 in synchronization with one another are processed by a workstation (not shown).

Here, let Sw($\omega$), Y($\omega$) and IR($\omega$) denote the source sound in frequency-domain representation (namely, the reference data), the sound to be measured, which is in frequency-domain representation, (namely, the data to be measured) and the head-related transfer characteristics in frequency-domain representation obtained at the measurement positions, respectively. Further, the relation among input and output data is represented by the following equation:

$$Y(\omega)=IR(\omega)\cdot sw(\omega) \tag{4}$$

Thus, IR($\omega$) is obtained as follows:

$$IR(\omega)=Y(\omega)/sw(\omega) \tag{5}$$

Thus, the reference data sw(t) and the measured data l(t) and r(t) obtained in step 101 are extracted as the reference data Sw($\omega$) and the measured data Y($\omega$) by using synchronized windows and performing FFT thereon to expand the extracted data into finite Fourier series with respect to discrete frequencies. Finally, the head related transfer characteristics IR($\omega$) composed of a pair of left and right transfer characteristics corresponding to each, sound image location are calculated and estimated from the equation (5).

In this manner, the head related transfer characteristics respectively corresponding to 12 positions set every 30 degrees as illustrated in, for example, FIG. 5, are obtained. Incidentally, hereinafter, the head related transfer characteristics composed of a pair of left and right transfer characteristics will be referred to simply as head related transfer characteristics (namely, an impulse response). Further, the left and right transfer characteristics will not be referred to individually. Moreover, the head related transfer characteristics in time-domain representation will be denoted by ir(t) and those in frequency-domain representation will be denoted by IR($\omega$).

Further, the time-base response (namely, the impulse response) ir(t) (namely, a first impulse response) is obtained by performing an inverse FFT on the computed frequency responses IR($\omega$).

Incidentally, where the head related transfer characteristics are estimated in this way, it is preferable for improving the precision of IR($\omega$) (namely, improving S/N) to compute the frequency responses IR($\omega$) respectively corresponding to hundreds of windows which are different in time from one another, and to then average the computed frequency responses IR($\omega$).

③ Shaping of Head Related Transfer Characteristics (Impulse Response) ir(t) (step 103)

In this step, the impulse response ir(t) obtained in step 102 is shaped. First, the first impulse response ir(t) obtained in step 102 is expanded with respect to discrete frequencies by performing FFT over what is called an audio spectrum.

Thus, the frequency response IR($\omega$) is obtained. Moreover, components of an unnecessary band (for instance, large dips may occur in a high frequency band but such a band is unnecessary for the sound image localization) is eliminated from the frequency response IR($\omega$) by a band-pass filter (BPF) which has the passband of 50 hertz (Hz) to 16 kilo-hertz (kHz). As the result of such a band limitation, unnecessary peaks and dips existing on the frequency axis or base are removed. Thus, coefficients unnecessary for the localization filters are not generated. Consequently, the convergency can be improved and the number of coefficients of the localization filter can be reduced.

Then, an inverse FFT is performed on the band-limited IR(ω) to obtain the impulse response ir(t). Subsequently, what is called a window processing is performed on ir(t) (namely, the impulse response) on the time base or axis by using an extraction window (for instance, a window represented by a cosine function). (Thus, a second impulse response ir(t) is obtained.) As the result of the window processing, only an effective portion of the impulse response can be extracted and thus the length (namely, the region of support) thereof becomes short. Consequently, the convergency of the localization filter becomes improved. Moreover, the sound quality does not become deteriorated.

Figure 7:
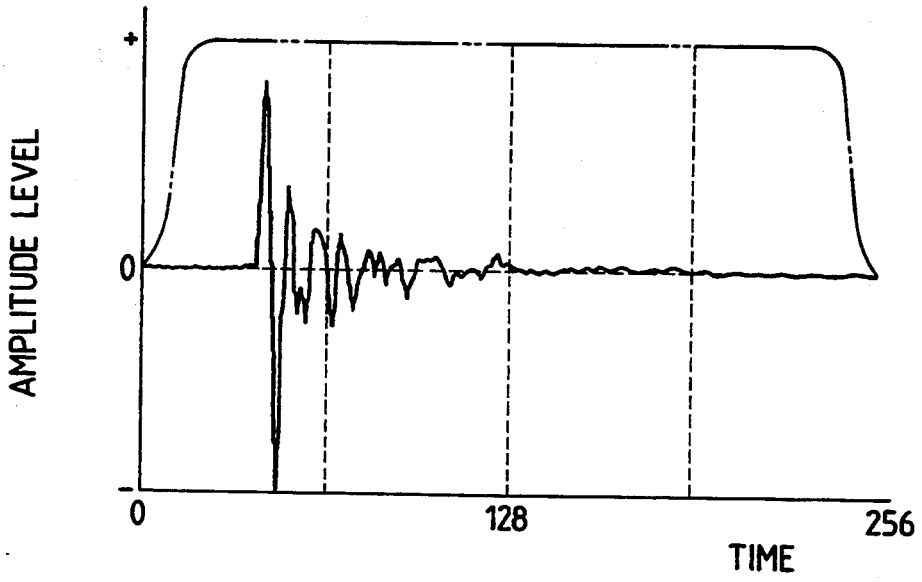
FIG. 7 is a graph for illustrating a practical example of the head related transfer characteristics (IR)

Practical example of the head related transfer characteristics ir(t) (namely, the impulse response) is shown in FIG. 7. In this graph, the horizontal axis represents time (namely, time designated in clock units (incidentally, the frequency of a sampling clock is 48 kHz)) and the vertical axis represents amplitude levels. Further, two-dot chain lines indicate extraction windows.

Incidentally, it is not always necessary to generate the first impulse response ir(t). Namely, the FFT transform and the inverse FFT transform to be performed before the generation of the first impulse response ir(t) is effected may be omitted. However, the first impulse response it(t) can be utilized for monitoring and can be reserved as the proto-type of the coefficients. For example, the effects of the BPF can be confirmed on the time axis by comparing the first impulse response ir(t) with the second impulse response ir(t). Moreover, it can be also confirmed whether the filtering performed according to the coefficients does not converge but oscillates. Furthermore, the first impulse response ir(t) can be preserved as basic transfer characteristics to be used for obtaining the head related transfer characteristics at the intermediate position by computation instead of actual observation.

(4) Calculation of Transfer Characteristics cfLx(t) and cfRx(t) of Localization Filters (step 104)

The time-domain transfer characteristics cfLx(t) and cfRx(t) of the pair of the localization filters, which are necessary for localizing a sound image at a target position x, are given by the equations (3b1) and (3b2) as above described. Namely, $$cfLx(t)=\{h2R(t)*pLx(t)-h2L(t)*pRx(t)\}*g(t) \quad (3b1)$$

$$cfRx(t)=\{-h1R(t)*pLx(t)+h1L(t)*pRx(t)\}*g(t) \quad (3b2)$$

where g(t) is an inverse Fourier transform of $G(\omega)=1/\{H1L(\omega)\cdot H2R(\omega)-H2L(\omega)\cdot H1R(\int)\}$.

Figure 6:
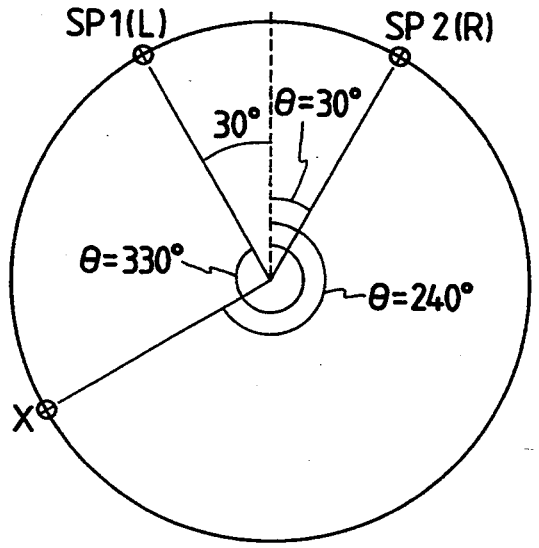
FIG. 6 is a diagram for illustrating an example of the calculation of the coefficients of the localization filters.

Here, it is supposed that the speakers sp1 and sp2 are placed in the directions corresponding to azimuth angles of 30 degrees leftwardly and rightwardly from the very front of the dummy head (corresponding to $\theta=330$ degrees and $\theta=30$ degrees, respectively) as illustrated in FIG. 6 (namely, 30 degrees counterclockwise and clockwise from the central vertical radius indicated by a dashed line, as viewed in this figure) and that the target positions corresponding to $\theta$ are set every 30 degrees as shown in FIG. 5. Hereinafter, it will be described how the transfer characteristics cfLx(t) and cfRx(t) of the localization filters are obtained from the head related transfer characteristics composed of the pair of the left and right transfer characteristics, namely, the pair of the left and right second impulse responses (ir(t)), which are obtained in steps 101 to 103 correspondingly to angles $\theta$ and are shaped.

Firstly, the second impulse response ir(t) corresponding to $\theta=330$ degrees is substituted for the head-related transfer characteristics h1L(t) and h1R(t) of the equations (3b1) and (3b2). Further, the second impulse response ir(t) corresponding to $\theta=30$ degrees is substituted for the head-related transfer characteristics h2L(t) and h2R(t) of the equations (3b1) and (3b2). Moreover, the second impulse response ir(t) corresponding to the target localization position x is substituted for the head-related transfer characteristics pLx(t) and pRx(t) of the equations (3b1) and (3b2).

On the other hand, the function g(t) of time t is an inverse Fourier transform of G(ω) which is a kind of an inverse filter of the term $\{H1L(\omega)\cdot H2R(\omega)-H2L(\omega)\cdot H1R(\omega)\}$. Further, the function g(t) does not depend on the target sound image position or location x but depends on the positions (namely, $\theta=330$ degrees and $\theta=30$ degrees) at which the speakers sp1 and sp2 are placed. This time-dependent function g(t) can be relatively easily obtained from the head-related transfer characteristics h1L(t), h1R(t), h2L(t) and h2R(t) by using a method of least squares. This respect is described in detail in, for instance, the article entitled "Inverse filter design program based on least square criterion", Journal of Acoustical Society of Japan, 43[4], pp. 267 to 276, 1987.

The time-dependent function g(t) obtained by using the method of least squares as above described is substituted for the equations (3b1) and (3b2). Then, the pair of the transfer characteristics cfLx(t) and cfRx(t) for localizing a sound image at each sound image location are obtained not adaptively but uniquely as a time-base or time-domain impulse response by performing the convolution operations according to the equations (3b1) and (3b2). Furthermore, the coefficients (namely, the sequence of the coefficients) are used as the coefficient data.

As described above, the transfer characteristics cfLx(t) and cfRx(t) of an entire space (360 degrees) are obtained correspondingly to the target sound image locations or positions established every 30 degrees over a wide space (namely, the entire space), the corresponding azimuth angles of which are within the range from the very front of the dummy head to 90 degrees clockwise and anticlockwise (incidentally, the desired location of the sound image is included in such a range) and may be beyond such a range. Incidentally, hereinafter, it is assumed that the characters cfLx(t) and cfRx(t) designate the transfer characteristics (namely, the impulse response) of the localization filters, as well as the coefficients (namely, the sequence of the coefficients).

As is apparent from the equations (3b1) and (3b2), it is very important for reducing the number of the coefficients (namely, the number of taps) of the localization filters 20, 21 (the corresponding transfer characteristics cfLx(t) and cfRx(t)) to "shorten" (namely, reduce what is called the effective length of) the head-related transfer characteristics h1L(t), h1R(t), h2L(t), h2R(t), pRx(t) and pLx(t). For this purpose, various processing (for instance, a window processing and a shaping processing) is effected in steps 101 to 103, as described above, to "shorten" the head-related transfer characteristics (namely, the impulse response) ir(t) to be substituted for h1L(t), . . . , and h2R(t).

Figure 8:
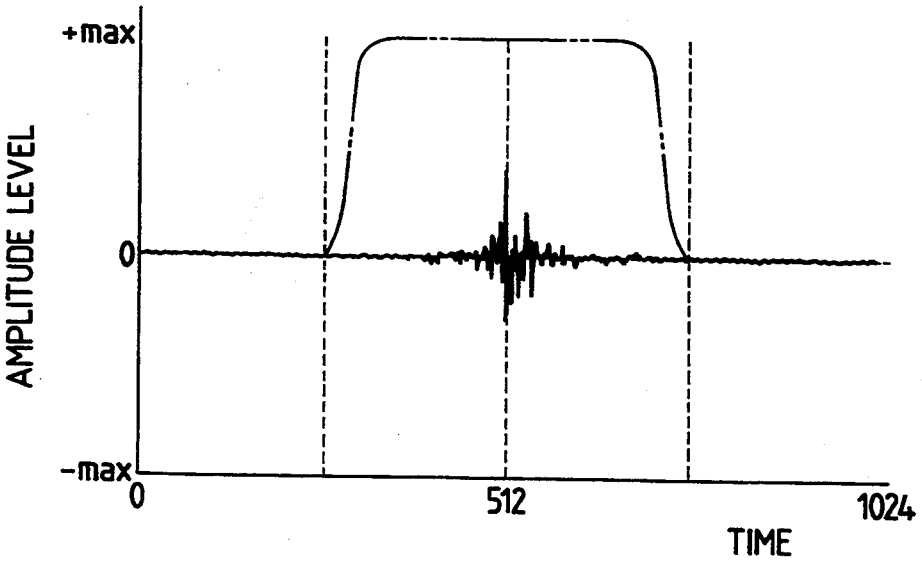
FIG. 8 is a graph for illustrating a practical example of the coefficients of the localization filters.

FIG. 8 shows a practical example of the transfer characteristics (namely, the sequence of the coefficients) cfLx(t) and cfRx(t) of the localization filters. In this graph, the horizontal axis represents time (namely, time designated in clock units (incidentally, the frequency of a sampling clock is 48 kHz)) and the vertical axis represents amplitude levels. Further, two-dot chain lines indicate extraction windows. However, the frequency response of the coefficients cfLx and cfRx have unnecessary peaks and dips.

Further, the transfer characteristics (namely, the coefficients) of the localization filters may be obtained by performing FFT on the transfer characteristics (namely, the coefficients) cfLx(t) and cfRx(t) calculated as described above to find the frequency response, and then performing a moving average processing on the frequency response using a constant predetermined shifting width and finally effecting an inverse FFT of the result of the moving average processing. The unnecessary peaks and dips can be removed as the result of the moving average processing. Thus, the convergence of the time response to be realized can be quickened and the size of the cancellation filter can be reduced.

(5) Scaling of Coefficients of Localization Filters Corresponding to Each Sound Image Location (step 105)

One of the spectral distributions of the source sounds of the sound source, on which the sound image localization processing is actually effected by using the convolvers (namely, the localization filters), is like that of pink noise. In case of another spectral distribution of the source sounds, the intensity level gradually decreases in a high (namely, long) length region. In any case, the source sound of the sound source is different from single tone. Therefore, when the convolution operation (or integration) is effected, an overflow may occur. As a result, a distortion in signal may occur.

Thus, to prevent an occurrence of an overflow, the coefficient having a maximum gain is first detected among the coefficients cfLx(t) and cfRx(t) of the localization filters 20, 21. Then, the scaling of all of the coefficients is effected in such a manner that no overflow occurs when the convolution of the coefficient having the maximum gain and a white noise level of 0 dB is performed.

Namely, the sum of squares of each set of the coefficients cfLx(t) and cfRx(t) of the localization filters is first obtained. Then, the localization filter having a maximum sum of the squares of each set of the coefficients thereof is found. Further, the scaling of the coefficients is performed such that no overflow occurs in the found localization filter having the maximum sum. Incidentally, a same scaling ratio is used for the scaling of the coefficients of all of the localization filters in order not to lose the balance of the localization filters corresponding to sound image locations, respectively.

Practically, it is preferable to attenuate the amplitude such that the ratio of the maximum absolute value of the coefficients to the permitted level (or amplitude) becomes within the range from 0.1 to 0.4 (for instance, 0.2).

Further, the window processing is performed according to the number of the practical coefficients (namely, the sequence of the coefficients) of the convolvers by using the windows (for example, cosine windows) of FIG. 8 such that the levels at both ends of the window becomes 0. Thus, the number of the coefficients is reduced.

As the result of performing the scaling processing in this way, coefficient data (namely, data on the groups of the coefficients of the impulse response) to be finally supplied to the localization filters (namely, convolvers to be described later) as the coefficients (namely, the sequence of the coefficients) are obtained. In case of this example, 12 sets or groups of the coefficients cfLx(t) and cfRx(t), by which the sound image can be localized at the positions set at angular intervals of 30 degrees, are obtained.

(6) Convolution Operation And Reproduction of Sound Signal Obtained from Sound Source (step 106)

Figure 2:
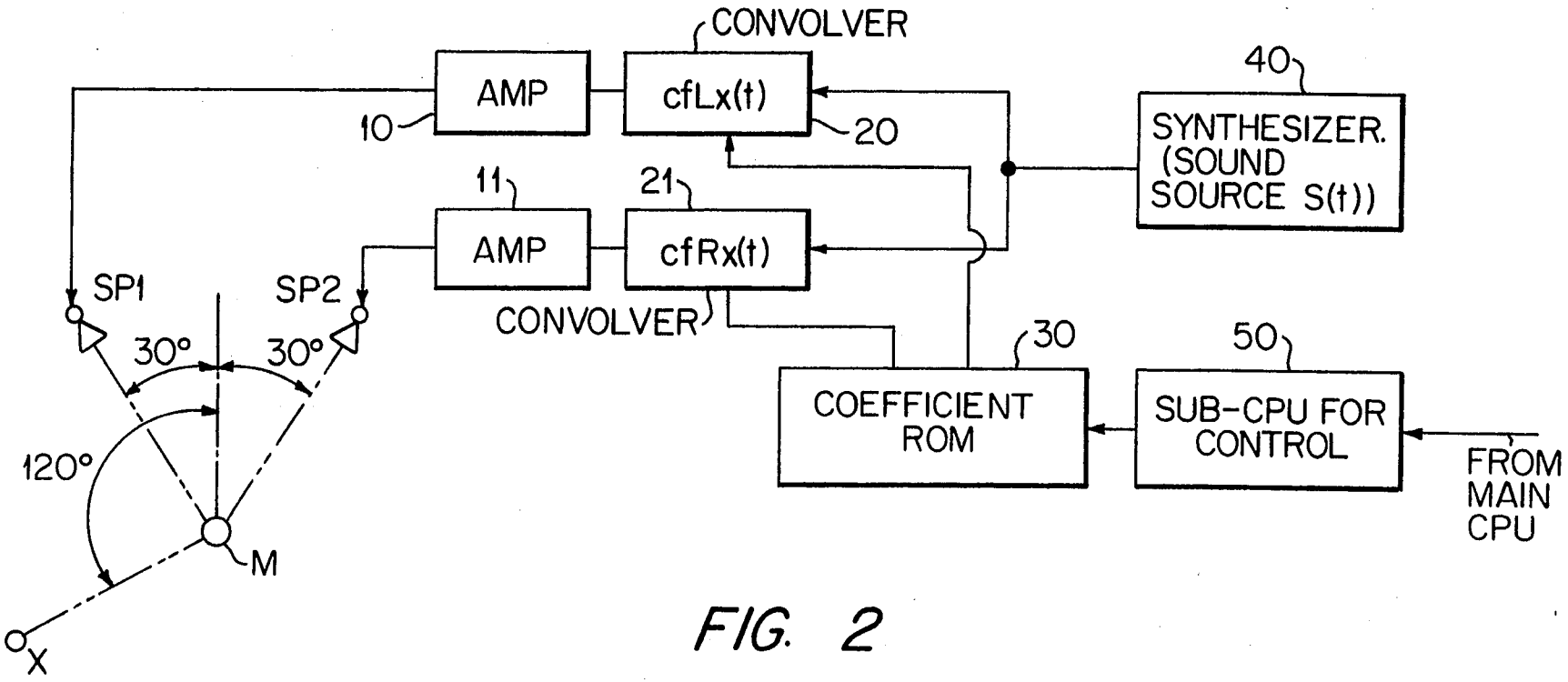
FIG. 2 is a schematic block diagram for illustrating the configuration of a system for performing the sound image localization according to the method for controlling sound image localization, embodying the present invention.

For example, as illustrated in FIG. 2, the speakers sp1 and sp2 are disposed apart from each other in the directions corresponding to counterclockwise and clockwise azimuth angles of 30 degrees from the very front of the operator of a game machine (namely, the listener), respectively, as an acoustic reproduction device having amplifiers 10, 11. Further, the pair of the speakers sp1 and sp2 is adapted to reproduce acoustic signals processed by the pair of the convolvers (namely, the convolution operation circuits 20, 21).

Furthermore, signals issued from the same sound source s(t) (for instance, sounds of an air plane which are generated by a synthesizer for use in the game machine) are supplied to the pair of the convolvers 20, 21. Moreover, selected ones of the coefficients cfLx(t) and cfRx(t) (for instance, the coefficient corresponding to $\theta=240$ degrees when the sound image corresponding to the sound of the air plane should be localized in the direction corresponding to $\theta=240$ degrees (namely, anticlockwise azimuth angle of 120 degrees)) are set in the convolvers 20, 21. For example, the coefficients corresponding to the desired location are transferred from the coefficient ROM 30 to the pair of the convolvers 20, 21 by a sub-central-processing-unit (sub-CPU) 50 for controlling the ROM according to a sound image localization instruction issued from the main CPU of the game machine or the like.

In this way, the time-base convolution operation is performed on the signals sent from the sound source s(t) 40. Then, the signals obtained as the result of the convolution operation are reproduced from the spaced-apart speakers sp1 and sp2. Thus, the crosstalk perceived by the ears of the listener is cancelled from the sounds reproduced from the pair of the speakers sp1 and sp2. As a consequence, the listener M hears the reproduced sounds as if the sound source were localized at the desired position. Consequently, extremely realistic sounds are reproduced.

Further, the optimum sound image location is selected or changed according to the movement of the air plane in response to the manipulation by the operator. Furthermore, the corresponding coefficients are selected. Moreover, when the sounds of the air plane should be replaced with those of a missile, the source sound to be issued from the sound source s(t) is changed from the sound of the air plane to that of the missile. In this manner, the sound image can be freely localized at a given position.

Incidentally, headphones may be used as the transducer for reproducing the sound instead of the pair of the speakers sp1 and sp2. In this case, the conditions of measuring the head related transfer characteristics are different from those in case of using the speakers. Thus, the different coefficients are prepared and used according to the condition of the reproduction.

Moreover, the shaping processing of the IR (namely, the impulse response) performed in step 103 is not always necessary. If omitted, the sound image localization can be controlled.

Further, the above described configuration of the system for performing this method (namely, the first embodiment), in which the signals supplied from the same sound source through the pair of the convolvers are reproduced by the pair of the spaced-apart transducers, is a minimum configuration required for obtaining the effects of the present invention. Therefore, if necessary, two or more transducers and convolvers may be added to the system, as a matter of course. Furthermore, if the coefficients of the convolver are "long", the coefficients may be divided and a plurality of convolvers may be added to the system.

Further, the coefficients of the convolvers vary with what is called an unfolding angle (namely, the angle sp1-M-sp2 of FIG. 2). Thus, the coefficients corresponding to the unfolding angles may be preliminarily determined such that the coefficients can be selectively used according to the practical reproducing system. Namely, in the above described embodiment, the coefficients needed in case where the speakers sp1 and sp2 are disposed in the directions corresponding to the counterclockwise and clockwise azimuth angles of 30 degrees from the very front of the listener, namely, in case that the unfolding angle is 60 degrees. However, at the time of calculating the coefficients of the localization filters, the IRs corresponding to other unfolding angles (for example, 45 degrees and 30 degrees) may be substituted for the head-related transfer characteristics h1L(t), h1R(t), h2L(t) and h2R(t) corresponding to the speakers sp1 and sp2.

Furthermore, the coefficients of the convolvers vary with the conditions of the measurement of the head related transfer characteristics. This may be taken into consideration. Namely, there is a difference in size of a head among persons. Thus, when measuring the basic data on the head related transfer characteristics in step 101, several kinds of the basic data may be measured by using the dummy heads (or human heads) of various sizes such that the coefficients (namely, the coefficients suitable for an adult having a large head and those suitable for a child having a small head) can be selectively used according to the listener.

Meanwhile, in the foregoing description, it is assumed that the target sound image locations are established at 12 positions set every 30 degrees. However, a larger number of the positions, at which the sound image locations are set, are necessary for realizing the higher-picture-quality (namely, more realistic) sound image localization control. Further, it takes much time, labour and cost to perform the processing, which should be effected in steps 101 to 106, correspondingly to all of such positions, respectively. Moreover, it is necessary to store many measured and collected transfer characteristics data as data on a sound image localization apparatus. Thus, the size of the apparatus should become large. Namely, the capacity of the coefficient ROM 30 for the digital filters 20, 21 (i.e., the convolvers) of the sound image localization control apparatus should be increased considerably. In such a case, the coefficients corresponding to the intermediate positions may be computed on the basis of the observed coefficients in step 104 or 106 (in case of a second embodiment to be described later, in step 205 or 206). This will be described in detail hereinbelow.

Previously, there have been made attempts to compute transfer characteristics (hereunder referred to as the intermediate transfer characteristics) corresponding to an intermediate position between the sound image locations from the transfer characteristics (hereunder referred to as the reference transfer characteristics) actually observed at the sound image locations without actually observing the transfer characteristics at the intermediate position. Conventionally, the intermediate transfer characteristics are obtained by calculating the arithmetic mean of the reference transfer characteristics observed at the two sound image locations. Namely, in case of the calculation in a time domain, the arithmetic mean of the time response waveforms of the reference characteristics (namely, the arithmetic mean of the amplitudes corresponding to the same time) is regarded as the intermediate transfer characteristics. Further, in case of the calculation in a frequency domain, the arithmetic mean of the frequency responses of the reference characteristics (namely, the arithmetic mean of the vectors corresponding to the same frequency) is regarded as the intermediate transfer characteristics.

Figure 11A:
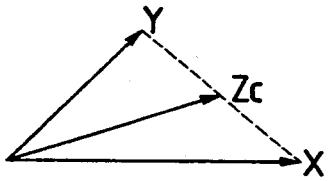
FIGS. 11(A) and 11(B) are diagrams for illustrating among two vector values of reference transfer characteristics and a vector average thereof.
Figure 11B:
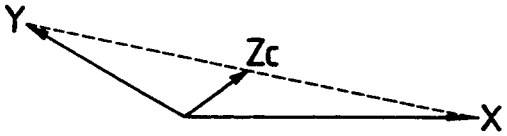

However, in case of averaging the vectors, the following inconvenience occurs. Namely, let X and Y denote the vector values of the two reference transfer characteristics corresponding to a discrete frequency. Further, let Zc designate the vector average of X and Y (namely, $Zc=(X+Y)/2$). FIGS. 11(A) and 11(B) show the relation among X, Y and Zc. As illustrated in FIG. 11(A), when the difference in phase between X and Y is small, the vector average Zc may be regarded as the intermediate transfer characteristics. In contrast, in case where the difference in phase between the vectors X and Y is large and the magnitudes of the vectors X and Y are comparable with each other as illustrated in FIG. 11(B), the magnitude of the vector average Zc becomes rather smaller than that of each of the vectors X and Y. Therefore, it is unreasonable that the vector average Zc is regarded as the intermediate transfer characteristics.

In such a case, the geometric mean of the magnitudes (the absolute values) of the amplitude characteristics of the two reference transfer characteristics is obtained as the frequency-amplitude characteristics of the intermediate transfer characteristics. Further, the vector average of the frequency complex vectors of the two reference transfer characteristics is obtained as the frequency-phase characteristics of the intermediate transfer characteristics. Namely, the frequency complex vector Zp of the intermediate transfer characteristics is obtained by the following equation:

$$Zp=(|X|\cdot|Y|)^{\frac{1}{2}}\cdot exp(j\cdot arg(X+Y)) \quad (4)$$

where character j represents imaginary unit.

Figure 12A:
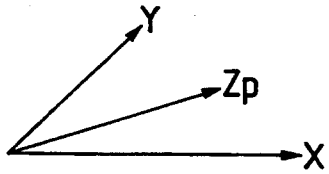
FIGS. 12(A) and 12(B) are diagrams for illustrating among two vector values of reference transfer characteristics and a frequency complex vector of intermediate transfer characteristics.
Figure 12B:
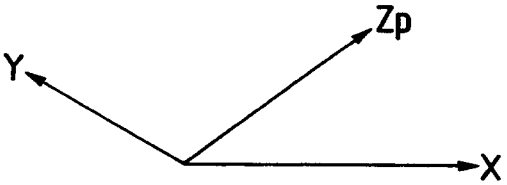

FIGS. 12(A) and 12(B) show the relation among the vectors Zp, X and Y. Even if the difference in phase between the vectors X and Y is small as illustrated in FIG. 12(A), and even if the difference in phase between the vectors X and Y is large as illustrated in FIG. 12(B), the magnitude of the vector Zp becomes medium in comparison with those of the vectors X and Y. Hence, it is reasonable that the vector value Zc is regarded as the intermediate transfer characteristics. Thus, the coefficients cfLx(t) and cfRx(t) of the convolvers 20, 21 at the intermediate positions are obtained by finding the vector Zp corresponding to each discrete frequency in this way and then performing an inverse FFT on the found vector Zp.

Figure 13A:
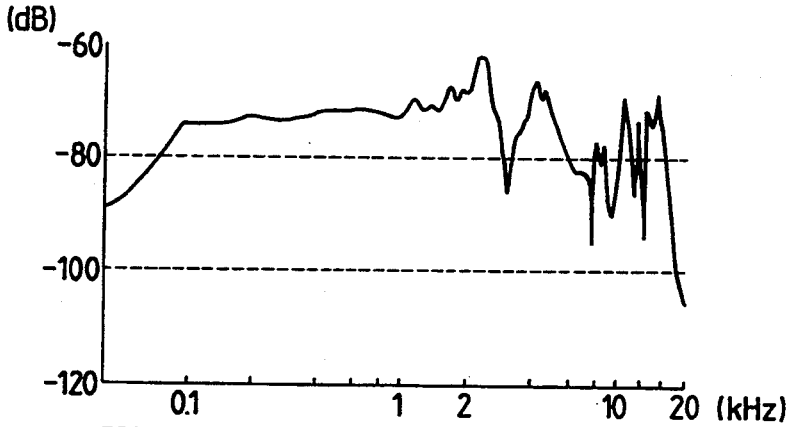
FIGS. 13(A) and 13(B) are diagrams for illustrating examples of the frequency-amplitude characteristics of the reference transfer characteristics obtained at intermediate positions being 30 degrees apart, respectively.
Figure 13B:
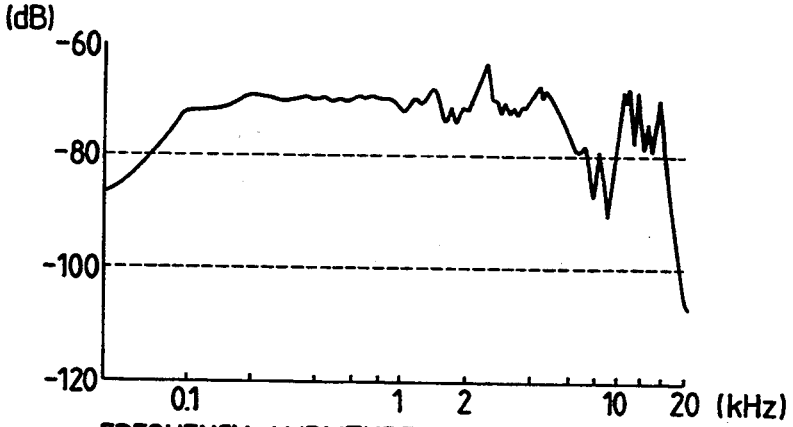
Figure 14A:
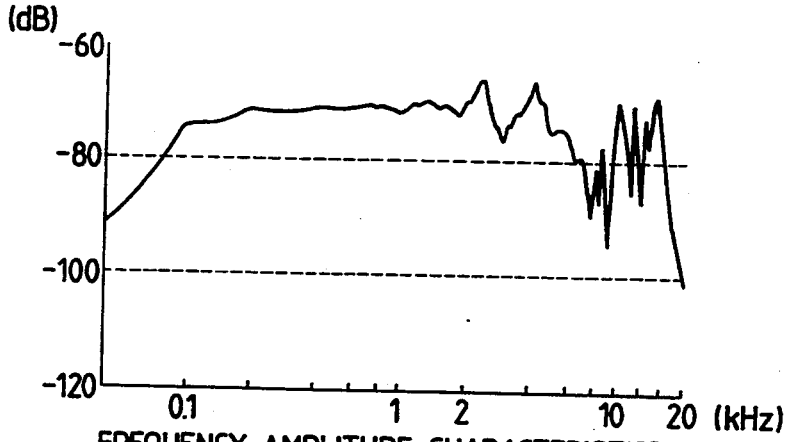
FIGS. 14(A), 14(B) and 14(C) are diagrams for illustrating the frequency-amplitude characteristics observed at the intermediate positions and the frequency-amplitude characteristics obtained from those of FIGS. 13(A) and 13(B) by using a vector average method and a method of an equation (4), respectively.
Figure 14B:
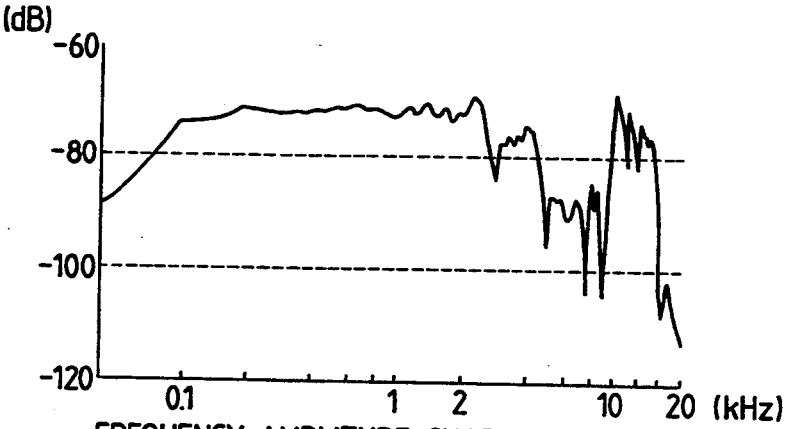
Figure 14C:
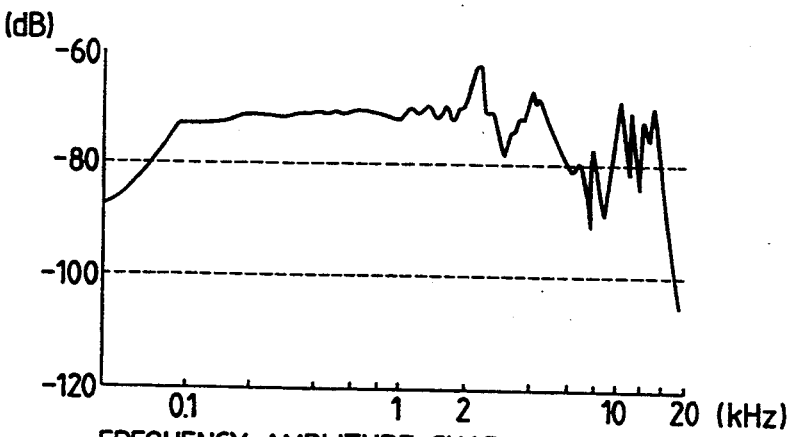

FIGS. 13(A) and 13(B) show examples of the frequency-amplitude characteristics (namely, the reference transfer characteristics) corresponding to two positions being 30 degrees apart. Further, FIG. 14(A) shows the frequency-amplitude characteristics observed at an intermediate position between these two positions being 30 degrees apart. Moreover, FIG. 14(B)

shows the frequency-amplitude characteristics corresponding to the intermediate position, which are calculated by effecting the method of calculating the vector average. Furthermore, FIG. 14(C) shows the frequency-amplitude characteristics corresponding to the intermediate position, which are calculated by using the equation (4). As is apparent from the comparison between FIGS. 14(B) and 14(C), the intermediate transfer characteristics of FIG. 14(C) obtained from the equation (4) resembles those observed at the intermediate position more closely by far than those of FIG. 14(B) obtained by calculating the vector average.

Additionally, at the time of the measurement of the basic data on the head-related transfer characteristics in step 101, only data corresponding to a semicircle (namely, corresponding to the angles $\theta$ of 0 to 180 degrees) may be actually measured. Further, the actually measured data corresponding to this semicircle may be appropriated to data corresponding to the other semicircle. Thereby, the measurement of the head-related transfer characteristics can be facilitated. Moreover, unnecessary fine calculation of the IRs and the coefficients can be avoided. Furthermore, sometimes, the coefficients serving for achieving good sound image localization can be obtained.

As described above, in accordance with the first embodiment of the present invention, the sound image is localized by performing a time-base processing on signals sent from the sound source by use of the convolvers. Thus, only the time-base convolution operation circuits are needed as circuits for actually performing a sound image processing, as illustrated in step 106. Consequently, the size of the circuit becomes very small and the cost becomes very low. Namely, a complex circuit of the conventional system for performing FFT of signals from the sound source, the frequency-base processing and the inverse FFT and reproducing the sounds is not necessary.

Moreover, the coefficient data used for the sound image processing performed by the convolvers is finally supplied as time-base IR (impulse response) data. Thus, the size of the circuit can be further reduced by reducing the number of the coefficients of the convolvers (namely, shortening the sequence of the coefficients of the convolvers). As a result, in comparison with the approximation of the frequency-base data in case of the conventional method, the head-related transfer characteristics corresponding to each sound image location and the transfer characteristics (the coefficients) for the sound image localization can be approximated more precisely and efficiently by effecting the processing in steps 101 to 105. Thus, the size of the circuit can be further reduced without deteriorating the sound image localization.

Furthermore, in case of this embodiment, data representing the IR (namely, the impulse response) is supplied to the convolvers as the coefficients. Thus, the IRs used as the coefficients can be found from the optimal solution in time domain easily and uniquely but not adaptively. Moreover, the delay time of the time-base response waveform can be definitely determined. Consequently, the timing relation among the response waveforms corresponding to a plurality of points can be controlled precisely. Furthermore, the coefficients of the convolvers can be accurately determined on the basis of the actually measured data with respect to the phase and amplitude corresponding to each frequency. Further, the sound image can be localized at a given position in a large space which subtends a visual angle of more than 180 degrees at the listener's eye.

Further, if data for estimating the head-related transfer characteristics at each location is measured in step 101 by using a white noise as the signal for the measurement, the S/N can be improved. Consequently, the head-related transfer characteristics (thus, the impulse response and the coefficients to be based thereon) can be obtained with high accuracy.

Moreover, if the plurality of the impulse responses obtained respectively corresponding to the head-related transfer characteristics which correspond to the sound image locations are averaged in step 101, namely, the responses $IR(\frac{1}{4})$ corresponding to hundreds of windows differing in time from one another are computed and then averaged in step 101, the S/N and the accuracy can be improved.

Additionally, the precision of the calculation of the localization filter can be improved by performing a shaping of IR (the impulse response) as in step 103, namely, obtaining the first impulse response corresponding to the estimated head-related transfer characteristics, then performing the predetermined processing (namely, the band limitation) on the first impulse response over the audio spectral discrete frequency band, subsequently performing the time-base window processing using the extraction windows (for example, the cosine windows) to obtain the second impulse response of which the length is converged to a predetermined value, and finally obtaining the coefficients of the pair of the localization filters.

In addition, the occurrence of a distortion in a reproduced sound due to an overflow occurring during the convolution operation can be prevented by effecting a scaling processing in step 105, namely, attenuating the amplitude such that the ratio of the maximum absolute value of the coefficients to the permitted maximum level becomes within the range from 0.1 to 0.4.

Figure 9:
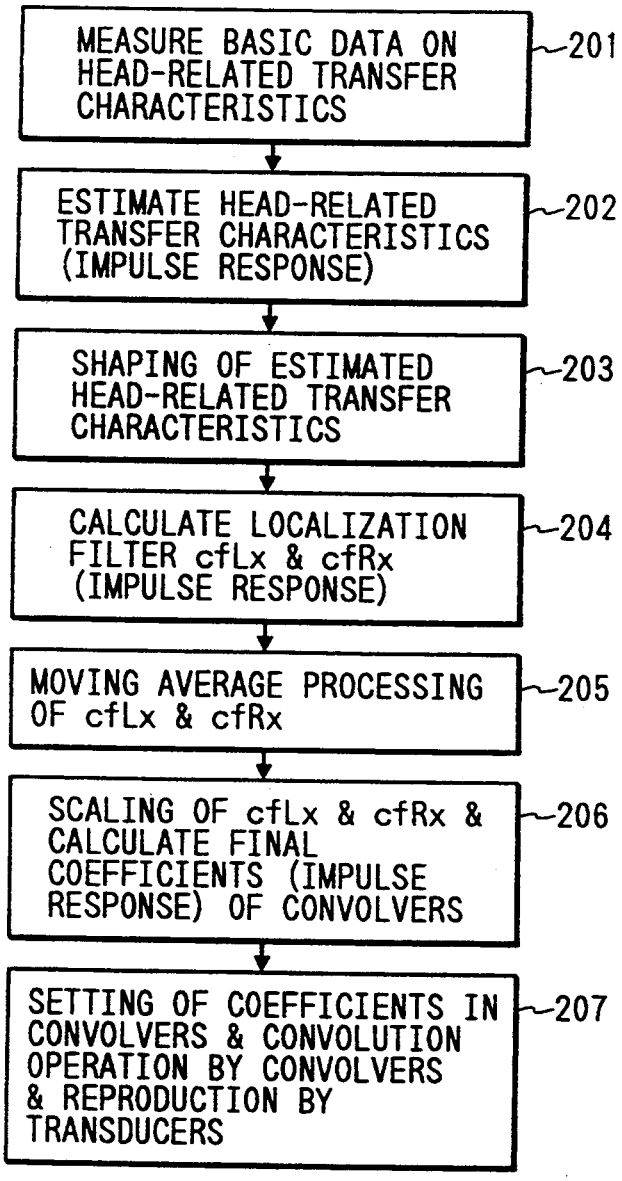
FIG. 9 is a flowchart for illustrating another method for controlling sound image localization according to the present invention (hereunder sometimes referred to as a second embodiment of the present invention)

Next, another method for controlling sound image localization according to the present invention (namely, the second embodiment of the present invention) will be described hereinafter by referring to FIGS. 9 and 10(A) to 10(D). Incidentally, steps 201 to 204, 206 and 207 of FIG. 9 are similar to steps 101 to 104, 105 and 106 of FIG. 1, respectively. Therefore, the descriptions of steps 201 to 204, 206 and 207 are omitted for the simplicity of description.

Consequently, a moving average processing of coefficients cfLx(t) and cfRx(t) of localization filters (step 205) will be described in detail hereinbelow.

Incidentally, in case of the second embodiment, the localization filters finally obtained as the result of a scaling processing (to be described later) are referred to as the convolvers.

First, FFT of the coefficients of the localization filters (namely, the convolvers) cfLx(t) and cfRx(t) is effected to obtain the frequency response. Then, the moving average processing is performed on the obtained frequency response by using the width determined according to critical band width. This is an important feature of this embodiment and will be described in detail by referring to FIGS. 10(A) to 10(D).

Namely, first, $CFLx(\frac{1}{4})$ and $CFRx(\frac{1}{4})$ are obtained by effecting FFT of the coefficients cFLx(t) and cFRx(t) computed from the equations (3b1) and (3b2). Then, the moving average operation is performed on $CFLx(\frac{1}{4})$ and $CFRx(\frac{1}{4})$ obtained as a discrete frequency response. Subsequently, the time response of the localization filters is obtained by effecting an inverse FFT of the discrete frequency response on which the moving average operation has been performed.

Further, it is usual that when a moving average processing is effected, a band width is first established and then the moving average operation is performed on each frequency band by using the same band width. However, generally, human hearing sensation (namely, the sense of hearing) has characteristics referred to as a critical band, namely, is characterized in that the discrimination of a sound and the frequency analysis are effected according to band-pass characteristics of bands arranged over the entire audible frequency range and that generally, as the frequency becomes lower, the passband width becomes smaller and, as the frequency becomes higher, the passband width becomes larger. In case of this embodiment, the band width used in performing a moving average processing is optimized according to the critical band correspondingly to a frequency band to be processed.

Incidentally, the critical band width CBc (Hz) is given by the following equation:

$$CBc=25+75(1+1.4(f/1000)^2)^{0.69} \quad (5)$$

where f denotes the center frequency.

Figure 10A:
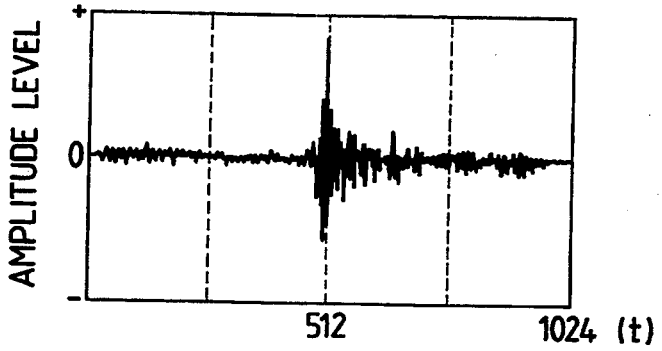
FIGS. 10(A) to 10(D) are diagrams for illustrating the second embodiment of the present invention.
Figure 10B:
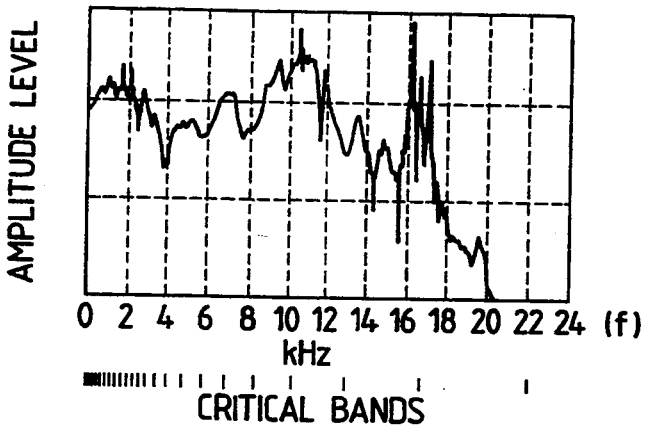
Figure 10C:
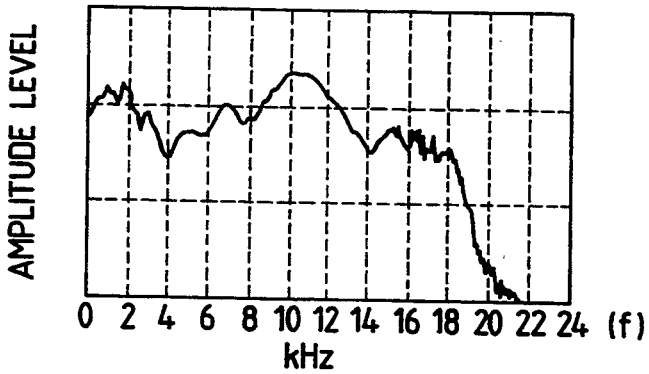
Figure 10D:
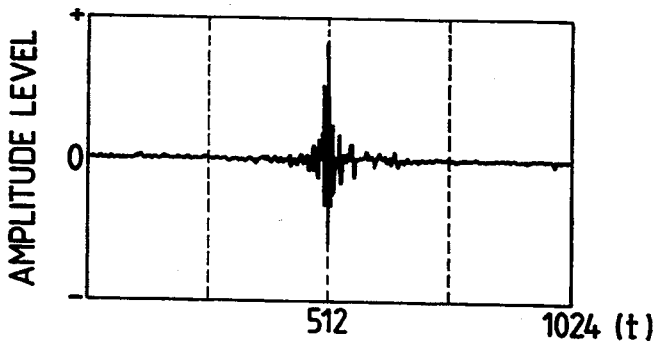

Further, the practical example of the above described operation is illustrated in FIGS. 10(A) to 10(D). FIG. 10(A) shows the time response (incidentally, this time response is at the same stage as of the response of FIG. 8) of the localization filters obtained from the equations (3b1) and (3b2) based on the measured head-related transfer characteristics. FIG. 10(B) shows the discrete frequency response obtained by performing FFT on the response shown in FIG. 10(A), and the critical band width CBc. FIG. 10(C) shows the discrete frequency response obtained by performing a moving average processing on the response shown in FIG. 10(B) according to the critical band width. FIG. 10(D) shows the time response of the localization filters obtained by performing an inverse FFT on the response shown in FIG. 10(C).

Thereby, as is apparent from FIGS. 10(C) and 10(D), the features of the frequency response in middle and low frequency ranges, features of which are necessary for sound image localization, can be maintained but unnecessary peaks and dips in a high frequency range can be eliminated. Thus, deterioration of the sound quality due to the unnecessary peaks and dips can be restrained. Simultaneously, the size of the localization filter (namely, the convolver) can be reduced.

Incidentally, in the foregoing description, the critical band width is defined by the equation (5). However, the critical band width of the present invention is not limited thereto. Other critical band widths (for example, a band width given by an equation similar to the equation (5), a band width given by an approximate logarithmic equation) may be employed upon condition that as the frequency becomes lower, the passband width becomes smaller and, as the frequency becomes higher, the passband width becomes larger.

While preferred embodiments of the present invention have been described above, it is to be understood that the present invention is not limited thereto and that other modifications will be apparent to those skilled in the art without departing from the spirit of the invention. The scope of the present invention, therefore, is to be determined solely by the appended claims.

What is claimed is:

1. A method for reproducing sounds from signals supplied from a sound source through a pair of convolvers employed as localization filters by using a pair of transducers disposed apart from each other and for controlling sound image localization to simulate a sound image localized at a location different from the positions of the transducers comprising the steps of:

measuring a signal, at the listener's position which originates from each sound image location to produce data for estimating head-related transfer characteristics;

estimating the head-related transfer characteristics for each of the sound image locations from the measured data;

calculating transfer characteristics of the pair of the localization filters, which are necessary for localizing a sound image at each of the sound image locations from the estimated head-related transfer characteristics;

scaling the coefficients of the localization filters within a permitted maximum level to obtain the coefficients of the pair of the localization filters as an impulse response, converged on a predetermined length, said impulse response being obtained from the steps of performing a band limitation in a frequency domain and window processing in a time domain on the estimated head-related transfer characteristics; and setting the coefficients obtained by the scaling processing in the pair of convolvers, and further supplying sound signals from the sound source to the pair of the convolvers which provide signals to the pair of transducers.

2. The method according to claim 1, wherein the data to be used for estimating the head-related transfer characteristics corresponding to each of the sound image locations are measured by generating white noise at said sound image location as the signal for estimating the head-related transfer characteristics.

3. The method according to claim 1, wherein a plurality of the head-related transfer characteristics are estimated corresponding to each of the sound image locations from a plurality of data measured at the listener's position from sound which originates from each sound image location and the head-related transfer characteristics corresponding to each of the sound image locations are obtained by averaging the estimated plurality of head-related transfer characteristics.

4. The method according to claim 1, wherein in the step of the scaling processing, a ratio of a maximum absolute value of the coefficients of the localization filters to a permitted maximum level is within a range from 0.1 to 0.4.

5. The method according to claim 1, wherein the transducers are speakers.

6. A method for reproducing sounds from signals supplied from a sound source through a pair of localization filters, by using transducers disposed apart from each other and for controlling the localization of a sound image to simulate sounds from a sound image which is localized at a desired sound image location different from the positions of the transducers, the method comprising the steps of:

obtaining transfer characteristics of the localization filters from head-related transfer characteristics measured at each sound image location;

obtaining a discrete frequency response by performing a fast Fourier transform of the head-related transfer characteristics and then taking a moving average using a band width optimized according to a critical band width, and performing an inverse fast fourier transform of data obtained as a result of the moving average to obtain modified transfer characteristics of the localization filters; and supplying signals produced by the localization filters which employ the modified transfer characteristics to the transducers to produce sounds which appear to emanate from said desired sound image location.

7. A method for reproducing sounds from signals supplied from a sound source through a pair of convolvers employed as localization filters to a pair of transducers disposed apart from each other, and for controlling sound image localization to simulate sounds from a sound image localized at a desired sound image location different from the positions of the transducers, the method comprising the steps of:

measuring a signal at a listener's position which originates from each sound image location as data to be used for estimating head-related transfer characteristics;

estimating the head-related transfer characteristics for each of the sound image locations from the measured data, and estimating intermediate transfer characteristics corresponding to each of a plurality of intermediate positions located between adjacent sound image locations by taking a geometric mean of the magnitudes of amplitude characteristics of the head-related transfer characteristics for two adjacent sound image locations as frequency-amplitude characteristics of corresponding intermediate head-related transfer characteristics, and also taking a vector average of frequency complex vectors of the head-related transfer characteristics for the two adjacent sound image locations as frequency-phase characteristics of the corresponding intermediate transfer characteristics;

calculating coefficients of the pair of the localization filters for localizing a sound image at each of the sound image locations, on the basis of the estimated head-related transfer characteristics;

scaling the calculated coefficients of the pair of the localization filters by using a predetermined ratio within a predetermined range of a maximum absolute value of the coefficients of the localization filters to a permitted maximum level; and setting the coefficients obtained from the scaling processing in the pair of convolvers, and further supplying sound signals from the sound source to the pair of the convolvers and from said convolvers to the pair of transducers.

* * * * *